US007892074B2

(12) United States Patent
Rivard

(10) Patent No.: US 7,892,074 B2
(45) Date of Patent: Feb. 22, 2011

(54) SURFACE MODIFYING TOOL ADAPTER USING A PLURALITY OF SURFACE MODIFYING ARTICLE INSERTS FOR USE IN A SURFACE MODIFYING SYSTEM

(75) Inventor: Allen J. Rivard, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/022,356

(22) Filed: Jan. 30, 2008

(65) Prior Publication Data

US 2009/0191799 A1 Jul. 30, 2009

(51) Int. Cl.
*B24B 23/00* (2006.01)

(52) U.S. Cl. ..... 451/259; 451/496

(58) Field of Classification Search ..... 451/259, 451/496, 508, 520, 490, 468, 469, 463
See application file for complete search history.

(56) References Cited

U.S. PATENT DOCUMENTS

| | | | | |
|---|---|---|---|---|
| 3,192,589 | A | 7/1965 | Pearson | |
| 3,522,681 | A * | 8/1970 | Lampert | 451/490 |
| 3,527,001 | A | 9/1970 | Kleemeier et al. | |
| 4,558,542 | A * | 12/1985 | Marton | 451/490 |
| 4,718,204 | A * | 1/1988 | Eisenblatter | 451/469 |
| 4,875,259 | A | 10/1989 | Appeldorn | |
| 5,097,570 | A | 3/1992 | Gershenson | |
| 5,201,149 | A * | 4/1993 | Eisenblatter | 451/526 |
| 5,439,413 | A | 8/1995 | Lagler | |
| 5,505,747 | A | 4/1996 | Chesley et al. | |
| 5,667,540 | A | 9/1997 | Chesley et al. | |
| 5,672,186 | A | 9/1997 | Chesley et al. | |
| 5,683,143 | A | 11/1997 | Peterson et al. | |
| 5,785,784 | A | 7/1998 | Chesley et al. | |
| 5,840,089 | A | 11/1998 | Chesley et al. | |
| 6,021,771 | A | 2/2000 | Swan et al. | |
| 6,197,076 | B1 | 3/2001 | Braunschweig et al. | |
| 6,210,389 | B1 | 4/2001 | Long et al. | |
| 6,261,164 | B1 * | 7/2001 | Rivard et al. | 451/359 |
| 6,394,887 | B1 | 5/2002 | Edinger | |
| 6,579,161 | B1 | 6/2003 | Chesley et al. | |
| 6,579,162 | B2 | 6/2003 | Chesley et al. | |
| 6,752,707 | B1 | 6/2004 | Palushi | |
| 7,104,739 | B2 | 9/2006 | Lagler | |
| 7,140,957 | B2 | 11/2006 | Thysell et al. | |
| 2005/0227599 | A1 | 10/2005 | Fisher | |

(Continued)

FOREIGN PATENT DOCUMENTS

JP 01-117854 U 8/1989

(Continued)

OTHER PUBLICATIONS

Sales Material from CENO Group, Houston, TX.

(Continued)

*Primary Examiner*—Robert Rose
(74) *Attorney, Agent, or Firm*—David B. Patchett

(57) ABSTRACT

A surface modifying apparatus, system, article, and method are disclosed for modifying a surface by surface modification, whereby inserts of surface modifying elements are quickly and easily replaceable on a carrier assembly therefor without being damaged during use.

18 Claims, 2 Drawing Sheets

U.S. PATENT DOCUMENTS

2005/0227600 A1 10/2005 Fisher

FOREIGN PATENT DOCUMENTS

JP 2004-298968 A 10/2004
JP 2007-210060 A 8/2007
WO WO 2007/093874 A1 8/2007

OTHER PUBLICATIONS

Instructions for Use Insta-Lok® Driving Assembly from Building Service& Cleaning Products Division/ 3M Corporation, St. Paul MN.
PCT lnternational Search Report PCT/ISA/210.

* cited by examiner

SURFACE MODIFYING TOOL ADAPTER USING A PLURALITY OF SURFACE MODIFYING ARTICLE INSERTS FOR USE IN A SURFACE MODIFYING SYSTEM

BACKGROUND

The present disclosure is directed to an apparatus and system for conditioning a surface. More particularly, it is directed to an easy to use and low cost surface modifying tool adapter including a plurality of removable surface modifying articles, such as abrasive article inserts, and a surface modifying tool system using such surface modifying tool adapter in a surface modifying method.

A variety of attachment systems have been employed to attach abrasive articles, such as abrasive sheets or discs, to a power surface modifying tool, such as a sanding tool, whereby the former is driven by the latter. Abrasive sheets and discs have relatively flexible constructions and are available in a wide variety of sizes and shapes. Typically, abrasive particles are on one major surface of abrasive discs or sheets. These kinds of abrasive articles are normally held in place on the surface modifying tool by a mechanical bolt and washer and the like that require user manipulations to mount and replace.

Typically, during surface modifying with a rotary abrader, disc shaped abrasive articles tend to wear adjacent their outer periphery more than towards their center. Because of the uneven wear, there may be a considerable amount of wastage of otherwise good abrasive particles near the center of the discs. Moreover, in response to forming abrasive discs, in the first instance, a considerable amount of sheet material from which the discs are cut is wasted, thereby compounding wastage of the single abrasive disc. This amount of wastage, for example, may be in the order of about 16% to about 23% for discs having 16-20 inch diameters. In addition, material in the center of such discs generally does not abrade as well as at the periphery of the disc or at all. It will be appreciated that the total wastage regarding the converting of sheet material to discs and the general loss of material at disc centers lead to wastage loss that may at times be considerable. Moreover, abrasive discs may become damaged during usage, such as in response to striking a protrusion (e.g., nail) from the working surface. Accordingly, the entire abrasive disc must be replaced. Not only is this costly since undamaged portions must be replaced, but in a surface modifying operation, such as sanding operation, the downtime increases due to the relatively tedious process of removing and replacing damaged discs. Furthermore, there is a desire to eliminate waste of materials in products, as well as in the manufacturing process.

SUMMARY

Accordingly, needs exist for an improved surface modifying tool adapter including a plurality of abrasive article inserts, and a surface modifying tool system using such surface modifying tool adapter and inserts for enabling easy coupling to a power tool, whereby the former is driven in order to perform surface conditioning operations on a working surface. These needs further include being able to easily and economically replace only those portions of a surface modifying assembly that have been damaged. Moreover, needs exist for reducing wasted materials in products, as well as in their manufacturing processes, as manufacturers strive for zero waste manufacturing.

The present description provides an apparatus comprising: a rotatable carrier; a plurality of surface modifying articles on the carrier, each of the surface modifying articles having a major surface modifying surface and at least a leading edge portion; and a retaining assembly on one of the carrier and the surface modifying article for retaining the leading edge portion of each of the surface modifying articles in spaced apart relationship from a working surface during surface modification by the major surface.

The present description provides a surface modifying system for modifying a working surface. The system comprises: a surface modifying power tool having a driving member rotatable about an axis; and, a surface modifying tool adapter connectable to the driving member, the surface modifying tool adapter including: a rotatable carrier; a plurality of surface modifying articles on the carrier, each of the surface modifying articles having a major surface modifying surface and at least a leading edge portion; and a retaining assembly on one of the carrier and the surface modifying article for retaining the leading edge portion of each of the surface modifying articles in spaced apart relationship from a working surface during surface modification by the major surface.

The present description provides a surface modifying assembly couplable to a surface modifying tool assembly. The surface modifying assembly comprises: a generally elongated body having first and second opposed major surfaces, and at least a leading edge portion; a surface modifying material on at least a portion of one of the first and second major surfaces that is spaced from the leading edge for modifying a working surface in a working plane; a first attachment mechanism portion for releasably attaching the leading edge portion to the surface modifying tool assembly; and a second attachment mechanism portion spaced from the first attachment portion for releasably holding a segment of the body against the surface modifying tool assembly so that the surface modifying material is generally linearly spaced from the leading edge portion and from the working plane.

The present description provides a method of modifying a surface with a surface modifying article. The method comprises: providing a plurality of surface modifying articles on a rotatable carrier, each of the surface modifying articles having a major surface modifying surface and at least a leading edge portion; and retaining the leading edge portion of each of the surface modifying articles in spaced apart relationship from a working surface during surface modification by the major surface.

Aspects of the present description provide a surface modifying tool adapter and surface modifying tool system that utilize replaceable abrasive or surface modifying assemblies.

Aspects of the present description provide a surface modifying tool adapter that is easily mountable to a power surface modifying tool system.

Aspects of the present description include use of surface modifying articles and adapters that substantially reduce the amount of material that is wasted by utilizing same sized segmented pieces for a wide range of disc diameters, thereby minimizing inventoried discs.

Aspects of the present description provide an economical approach that enables a low cost surface modifying tool adapter attachable to a power tool assembly.

Aspects of the present description include use of abrasive assembly inserts for providing low cost and convenient mounting and dismounting of abrasive articles.

Aspects of the present description include use of abrasive assembly inserts that facilitate replacement of only those abrasive pieces or segments that may be worn or damaged.

Aspects of the present description include use of surface modifying articles and adapters that substantially reduce the amount of material that is wasted in their construction.

Aspects of the present description include use of surface modifying articles and adapters that substantially reduce the amount of material that is wasted during manufacturing of disc shaped articles.

Aspects of the present description include use of surface modifying articles and adapters that provide dust relief by increasing efficiency of abrading by reducing build-up of dust accumulation between an abrading surface and the surface being abraded.

Aspects of the present description include use of surface modifying articles and adapters that achieve the foregoing advantages as well as allows for providing higher unit pressure.

Aspects of the present description include use of surface modifying articles and adapters that improve the surface modifying operations by floating over non-planar surfaces while abrading.

The aspects described herein are merely a few of the several that may be achieved by using the present description. The foregoing descriptions thereof do not suggest that the present disclosure must only be utilized in a specific manner to attain the foregoing aspects.

These and other features and aspects of the present description will be more fully understood from the following detailed description of exemplary embodiments.

DETAILED DESCRIPTION

Figure 1:
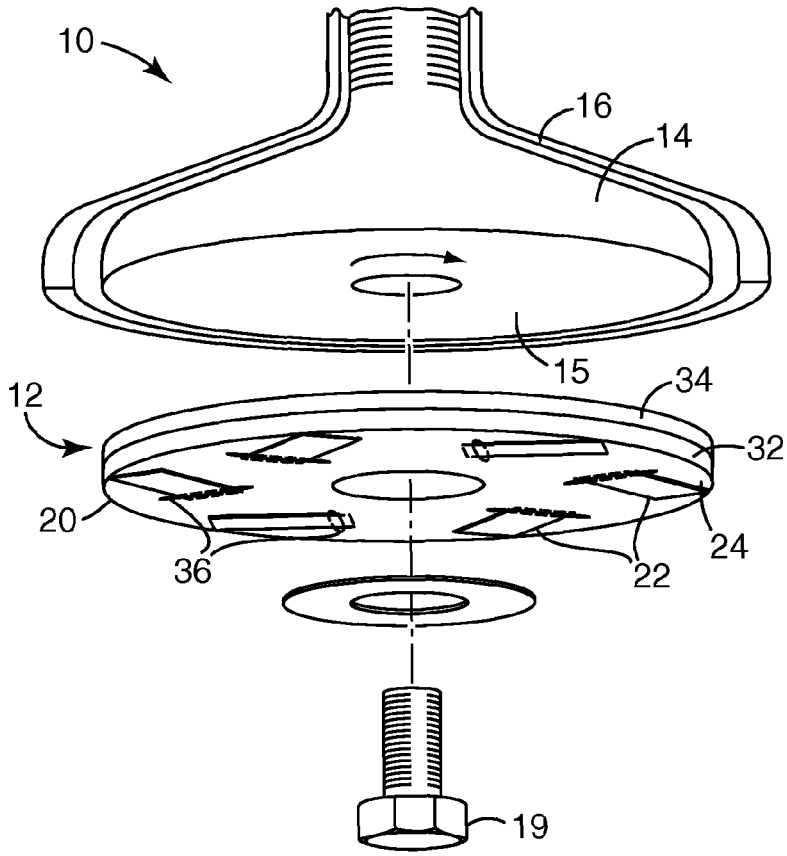
FIG. 1 is an exploded perspective schematic view of the components of the abrasive adapter and tool system using the former.
Figure 2:
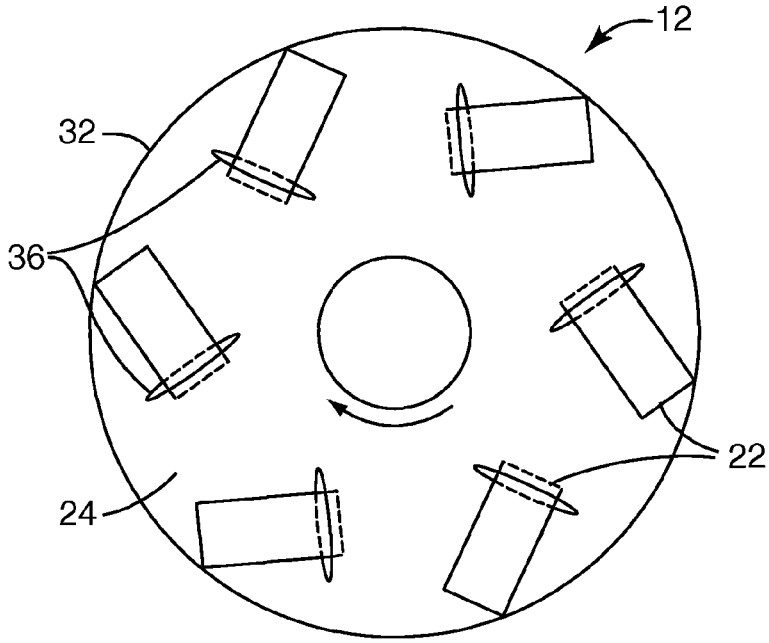
FIG. 2 is a planar schematic view of the abrasive adapter illustrating a plurality of abrasive assemblies mounted thereon.

The words "a", "an", and "the" are used interchangeably to mean one or more of the elements being described. By using words of orientation, such as "top", "bottom", and "backing" and the like for location of the various elements in the disclosed articles, I refer to the relative position of an element with respect to a horizontally-disposed body portion. It is not intended that the disclosed articles should have any particular orientation in space during or after their manufacture.

The present description is directed to FIGS. 1-3A that illustrate one exemplary embodiment of an improved surface treating system 10 that includes a surface modifying tool adapter 12, such as an abrasive tool adapter 12 connectable to a rotatable driving member 14 having a back-up surface 15 of a power tool 16 by suitable and known approaches. The surface modifying tool adapter 12 while described for abrading may perform a variety of surface treating operations that include, but are not limited to polishing, grinding, deburring, and the like. While the power tool 16 described may be a floor sanding machine 16, that is to abrade a working surface 18 (FIG. 3A), the present exemplary embodiment envisions use of other power tools that perform other operations that include, but are not limited to, polishing, buffing, deburring, or the like. The working surface 18 may be any suitable surface that may be treated, such as wood flooring, concrete, walls or non-horizontal surfaces or the like. A fastening element 19 and washer threadedly secure the tool adapter to the driving member or element 14. Any other suitable approach may be used including, but not limited to, pressure sensitive adhesives and hook and loop fastening elements.

In the exemplary embodiment, the surface modifying tool adapter 12, that is adapted to be connected to the rotatable driving member 14, may include a carrier assembly 20 that has a plurality of abrasive or surface modifying assemblies 22 that may be removable inserts or elements 22 carried thereby on a major generally planar surface 24 thereof. As will be described, the abrasive or surface modifying assemblies 22 may be releasably secured to the carrier assembly 20 by approaches to be described. Advantageously, because of the fact that there is not a continuous single sheet of an abrasive disc assembly covering the carrier assembly, considerable savings in material costs are realized utilizing such abrasive or surface modifying assemblies particularly those that have straight edges. It will be appreciated that use of abrasive assembly inserts or segments provide for low cost and convenient mounting and dismounting of abrasive articles. Moreover, such spaced abrasive inserts provide dust relief by increasing efficiency of abrading by reducing build-up of dust accumulation between an abrading surface and the surface being abraded since trapping of dust particles is diminished greatly.

In one exemplary embodiment the abrasive or surface modifying assemblies 22 are generally of the same size. Accordingly, one size may be used to fit different diameter or sized driving discs or members 14. It will be understood that the number of abrasive or surface modifying assemblies used may depend primarily on the diameter of the driving member or disk. In general, the larger the diameter of the driving member tool or adapter, the greater the number of abrasive or surface modifying assemblies that will be used. For example, a driving member 14 having a diameter of about 15 inches may have three (3) abrasive or surface modifying assemblies having a rectangular shape (e.g., 4 inches×6 inches). A driving member having a 20 inch diameter may have about six (6) abrasive or surface modifying assemblies of the size noted above.

This substantially reduces the amount of material that is wasted by utilizing same sized abrasive pieces for a wide range of disc diameters. This is also advantageous since it enables distributors to stock replacements having one size instead of a single sheet having a plurality of different disc sizes to match tools having different driving disc diameters. Advantageously, this approach reduces inventory.

Figure 3A:
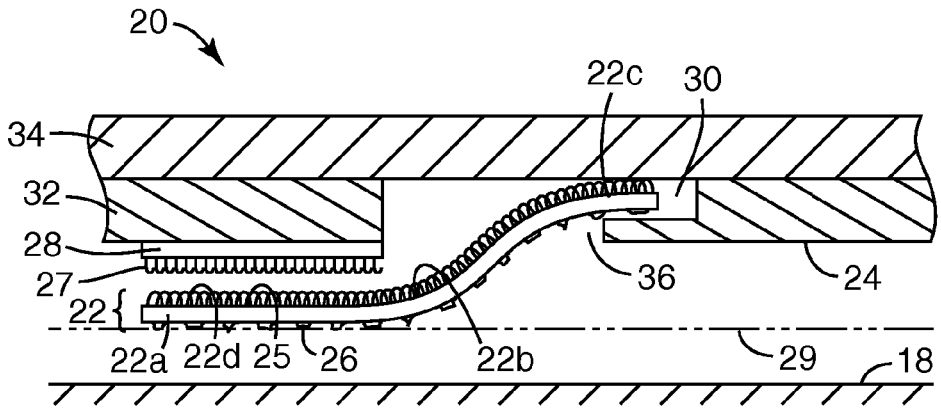
FIG. 3A is an enlarged and fragmented schematic elevation view illustrating an attachment of the adhesive assemblies being mounted to a carrier assembly.

While in an exemplary embodiment, the abrasive or surface modifying assemblies 22 appear to be made of the same constructions, shapes and sizes; those are not requirements of the present disclosure. A wide variety of materials, constructions, shapes and sizes may be used for the abrasive or surface modifying assemblies 22. The present description envisions many shapes having straight edges in order to reduce waste. Also, readily available round discs could be used, but with less waste reduction. In an exemplary embodiment, each of the abrasive or surface modifying assemblies 22 may be defined by a single generally elongated rectangular sheet for abrading the working surface 18 (FIG. 3A). It will also be appreciated that abrasive or surface modifying assemblies 22 may be trapezoidal or triangular in shape. Such configurations enable a web to be easily cut without waste as would be the case when forming discs.

An exemplary embodiment is illustrated in FIG. 3A, wherein the abrasive sheet assemblies 22 may have a first and second major opposed surface 22*a* and 22*b*; respectively, a leading edge 22*c*, and a remaining or trailing portion 22*d* that trails the leading edge. The first major surface 22*a* may retain the abrasive particles 26 that may be any suitable kind and size. The first major surface 22*a* may define a generally abrading or working plane 29. While the abrading particles 26 are disclosed, other surface treating particles for performing other surface treating operations may be used as noted. The second major surface 22*b* allows for a hook and loop type attachment mechanism 25 to be secured thereto. In this embodiment, the attachment mechanism 25 may comprise loops 25 that are securable directly to the carrier assembly 20 as viewed in FIG. 3A. The loops 25 may be coupled releasably to the hooks 27 of a hook and loop attachment mechanism 28 that is mounted on the major surface 24. Besides a hook and loop attachment mechanism other releasable mechanisms may be used that include, but not be limited to pressure-sensitive adhesive types of the removable or permanent type.

As illustrated, the abrasive or surface modifying assemblies 22 may be arranged in a spaced apart and generally circumferential relationship relative to each other about and adjacent the peripheral edge or extent of the major surface 24. By being placed adjacent the periphery, the abrasive or surface modifying assemblies 22 may apply more unit pressure than would be the case with a single abrasive disc encompassing the abrasive or surface modifying assemblies 22 (same total machine pressure over a smaller total contact area). Also, more abrading is performed because the abrasive assemblies at the periphery are rotating at higher speeds as compared to single discs areas (e.g., centers) that do not rotate at optimum speed. Dual-sided abrasive or surface modifying assemblies, although not shown, may be provided. The abrasive or surface modifying assemblies 22 may be made of any suitable materials and sizes. As such, they may be commercially available from 3M Company, St. Paul, Minn.

The present description envisions any suitable number of abrasive or surface modifying assemblies 22 may be used. The number may depend on the type of surface treating to be performed, as well the type of abrasive articles to be used. Their pattern of distribution may also vary depending on factors, such as the type of surface treatment to be performed. As noted, the abrasive or surface modifying assemblies 22 may have the same, similar or different configurations and abrasive qualities or characteristics. Since the abrasive or surface modifying assemblies 22 are to be rotated about an axis, it is important that their respective leading edges be spaced up and away from the surface modifying plane 29 so that they do not catch on or become damaged during abrading. While the leading edge 22*c* of this embodiment is a linear leading edge of a generally rectangular abrasive sheet 22, the leading edge may take any configuration and assume other orientations. Whatever configurations are selected, however, the leading edges should remain away from the surface modifying plane and otherwise protected to avoid being damaged or destroyed. In this regard, a wide variety of such protective retaining arrangements are envisioned by the present disclosure.

In one exemplary embodiment, the carrier assembly 20 may include a supporting member 32 and a retainer member 34. A two-piece construction made of a planar abrasive supporting member 32, such as a plate 32, and a retaining or retainer member 34, such as a plate 34 is illustrated, but a single member or plate may be used or a; plurality of plate segments may be used. The abrading tool adapter 12 is arranged to be removably secured to the power tool 16. The supporting member 32 and the retainer member 34; respectively, may be made of any suitable material and thickness that are appropriate for the surface(s) to be treated. In the exemplary embodiment, supporting member 32 may be made of fiberglass, and may also include, but not be limited to vulcanized rubber, laminated or pressed wood, metallic plates or the like. The supporting member 32 may have any suitable thickness to provide for reliability and durability. The retainer member 34 may be fixedly attached or removably coupled to the supporting member 32. In the exemplary embodiment, they may be coupled together in a generally coextensive relationship. It will be appreciated that such a relationship is not required since the retainer member 34 may be radially larger or smaller than the supporting member 32. Also, the geometries of the shapes of both the retainer member and the supporting member need not be the same. While the carrier assembly 20 is disclosed as including at least two components, it will be appreciated that other suitable numbers of components may be used including a unitary (i.e., one piece) body. The retainer assembly 34 of the present description encompasses any suitable structure(s) that can removably retain the surface modifying assemblies 22 on the carrier assembly 20 so as to perform abrading, but also protect the leading edges 22*c* to avoid or minimize their damage or destruction, and yet retain them so that they are easily replaceable.

Continued reference is made to FIGS. 1-3A for illustrating a low-cost and simple approach for retaining the abrasive or surface modifying assemblies 22. In this embodiment, the leading edge 22*c* is not secured to the carrier assembly. The exemplary embodiment includes a plurality of generally radially extending and generally oval-shaped openings 36. The openings 36 may be for removably receiving the leading edge 22*c* of a corresponding surface modifying assembly 22 that may be inserted therein for protection of the leading edge portion. As noted, the remaining or trailing portion 22*d* of each abrasive sheet assembly 22 may be removably attached to the carrier assembly by the loops 25. The inherent stiffness of the surface modifying article 22 and the fact that the trailing edge portion is secured by the hooks 27, as illustrated, allows the leading edge 22*c* to be retained within the recessed space 30 (defined by and between the plates) and hence, is spaced away from the abrading plane 29 and protected in the recessed space 30. While the recesses 30 and the openings 36 may be used to insure spacing and protection of the leading edges 22*c*, the leading edges may be retained in and by other structures (not shown). Instead of an opening 36, the present description envisions but is not limited to, channels (not shown), recesses (not shown) for keeping the leading edge 22*c* below the surface modifying plane.

Figure 3B:
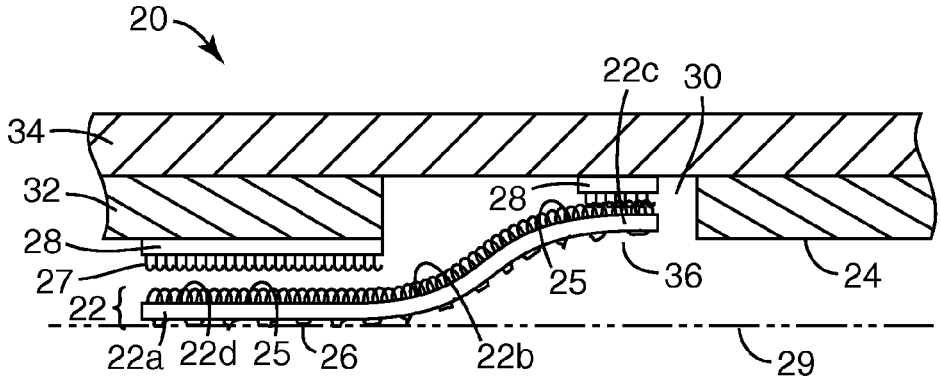
FIG. 3B is an enlarged and fragmented schematic elevation view of another exemplary embodiment of the present disclosure.

In the exemplary embodiment illustrated in FIG. 3B, releaseable loops 25 on leading edge portion 22*c* assist in releaseably retaining the latter to the hooks 27 of the attachment mechanism 28 that is located in the recess 30. As such, the leading edge portion 22*c* is releaseably fixed and may be prevented from being damaged or destroyed during rotation of the carrier assembly because the leading edge portion remains in the recess 30 spaced from the surface modifying plane 29. In this embodiment, as in the previous, the remaining or trailing edge portion 22*d* of the surface modifying assembly 22 is releaseably secured by the loops 25 to the hooks 27 of the attachment mechanism 28 that is mounted on the supporting member 32 to define the surface modifying plane 29. While the supporting member is illustrated as being solid, it will be appreciated that the supporting member 32 defined by and between the plates may be made of a resilient foam pad member. Alternatively, a resilient pad (not shown) may be placed between the attachment mechanism 28 and the supporting member 32.

The foregoing constructions are simple and yet effective in preventing the leading edge 22*c* from being damaged. The present description envisions use of a wide variety of suitable constructions to retain and protect the leading edge. Of course, the present disclosure envisions that the retaining assemblies 34 may include any suitable mechanical and/or adhesive joining system to be used for joining the surface modifying assemblies to the carrier assembly in either a permanent or releasable manner. For example, the retaining assemblies 34 may take several forms of construction including but not limited to clamps (not shown), retainers (not shown), or the like. The retaining assembly 34 may include any structure(s) that keeps a leading edge of the surface modifying assemblies away from the surface modifying plane. The present description envisions all kinds of equivalent retaining mechanisms for securing the leading edge portion to the carrier assembly.

The releasable assemblies instead of being carried by the carrier assembly may be included on the surface modifying assembly. The abrasive assemblies 22 may be removed and reused. During abrading, the abrasive assemblies tend to wear more towards their radially outward portions than their radial inward portions. As such, the abrasive assemblies may be rotated by 180 degrees following removal, whereby the less worn radial inward portion may be positioned so that they are the radial outward most portions.

Figure 4:
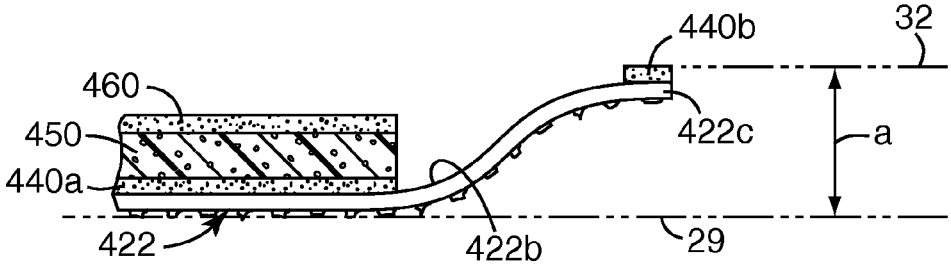
FIG. 4 is an enlarged schematic view illustrating an alternative embodiment of an abrasive assembly made according to one aspect of the present system.

FIG. 4 schematically illustrates another exemplary embodiment of a surface modifying sheet assembly 422. This embodiment includes a resilient pad 450 connected to the major surface 422*b* of the surface modifying sheet assembly 422 by pressure sensitive adhesive layer 440*a*. The resilient pad 450 may be releasably connected to the carrier assembly (not shown) by a pressure sensitive adhesive layer 460. Alternatively, the pressure sensitive adhesive layers 440*a* and 460 may be replaced by releasable mechanical attachment mechanisms that include, but are not limited, to hook and loop fastener elements. The resilient pad material may be made of any suitable material for the purposes intended, such as polyurethane foam or the like. The thickness of the resilient pad 450 may be selected to perform its force absorbing functions to provide floating of the surface modifying assembly. The embodiment also includes a pressure sensitive adhesive layer 440*b* to one side of the leading edge 422*c* as is illustrated so that the leading edge is releaseably secured to the carrier assembly. Instead of the resilient pad being mounted on the surface modifying assembly, it may be mounted directly to the carrier assembly 20. The resilient pad 450 may be coupled releasably to the carrier assembly by any suitable technique, such as by pressure sensitive adhesives, hook and loop fasteners and the like. Alternatively, the resilient pad may be replaced by a non-resilient member. Alternatively or additionally, the resilient pad may be placed on other locations. Accordingly, the resilient pads improve the surface modifying operations by being able to independently float over non-planar surfaces during abrading. Moreover, while resilient pads are used, the present description envisions the use of spring-like elements or other equivalent elements instead. The resilient pad will enable the abrasive assemblies to float over uneven surfaces. In the embodiments described above, the leading edge 22*c* may be spaced or gapped from the abrading plane 29 by an appropriate distance 'a'. In some embodiments, the gap 'a' may be in a range of from about ⅛ inch to about ¼ inch or more. The gap should be sufficient to avoid a leading edge from being struck by a nail or other similar projection during abrading.

Figure 5:
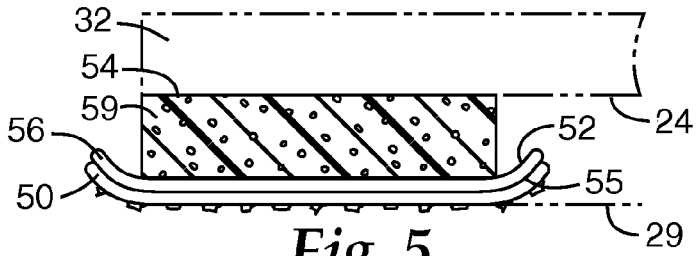
FIG. 5 is an enlarged view of another exemplary embodiment of the present disclosure.

FIG. 5 illustrates another exemplary embodiment of the present description, wherein the surface modifying element 50 is secured releaseably to a bowed guide plate 52, such as by a pressure sensitive adhesive or the like. Although not illustrated, other suitable releasable mechanisms may be used, such as, but not limited to, hook and loop fastener elements or other equivalent structure. The bowed plate 52 is attached, as by adhesives, to a resilient pad 59. The pad 59 is, in turn, carried by the supporting member 32 of the carrier assembly, such as by an adhesive layer 54 or any other suitable securing mechanism. The bowed plate 52 has opposed upwardly directed (as viewed in the drawing) end portions 56, to which corresponding leading and trailing edge portions 55 of the surface modifying element 50 may be releaseably secured. In this embodiment, the surface modifying element 50 is attached so that its end portions conform to the curvature of the bowed plate 52. As such, the end portions 56 are curved away from the surface modifying or abrading plane 29 so that they do not catch projections on a surface to be modified. It will be appreciated that instead of a bowed plate other structures may be used to ensure that the leading edges of the surface modifying element will not engage such projections. Of course, the leading edge portions are intended to remain from the abrading plane even if there is compression of the resilient pads as the latter permits floating of the surface modifying element. While both ends of the surface modifying element are retained in a direction away from surface modifying plane 29, such need not be the case. In addition, by keeping both ends of the surface modifying article in spaced relationship, the adapter 12 is reversible since either end may be the leading edge.

In addition, in the embodiments depicted in FIGS. 1-4, the surface modifying article may have both leading and trailing edges attached and protected, as in a corresponding opening. By being kept away from an abrading plane, such embodiments may be reversibly rotated. In this latter embodiment, it will be understood that an intermediate portion of the surface modifying article would be secured to the supporting member.

From the foregoing, it will be appreciated that the present disclosure enables the formation of articles, systems, and adapters that substantially reduce the amount of material that is wasted on surface modifying products, per se, and during their manufacture. As noted, the present description substantially reduces the amount of material that is wasted during manufacturing of disc shaped articles. Also, the present description includes use of surface modifying articles, such as abrasive articles, that substantially reduce the amount of material that is wasted since the same sized abrasive pieces may be used for a wide range of disc diameters. Accordingly, distributors, for example, need not stock as many pieces as would otherwise be the case.

The present disclosure enables the formation of articles, systems, and adapters that utilize replaceable abrasive or surface modifying assemblies that are easily mountable and dismountable to a power surface modifying tool system. Moreover, the present disclosure provides an economical approach that enables a low cost surface modifying tool adapter attachable to a power tool assembly.

Furthermore, the present description provides inserts for surface modifying assemblies, such as abrasive or surface modifying assemblies thereby enabling low cost and convenient mounting and dismounting of abrasive articles. The present description includes use of abrasive assembly inserts that facilitate replacement of only those abrasive portions that may be worn or damaged instead of an entire disc.

The present disclosure may take on various modifications and alterations without departing from the spirit and scope. Accordingly, this disclosure is not limited to the above-described embodiments, but may be controlled by limitations set forth in the following claims and any equivalents thereof.

What is claimed is:

1. An adapter comprising:

a rotatable carrier;

a plurality of surface modifying articles on the carrier, each of the surface modifying articles having a major surface modifying surface and at least a leading edge portion;

a retaining assembly on one of the carrier and a corresponding one of the plurality of surface modifying articles for retaining the leading edge portion of its corresponding one of the plurality of surface modifying articles in spaced apart relationship from a working surface;

a resilient member interposed between one of the surface modifying articles and the carrier; and a guide plate on the resilient member, the guide plate having portions that retain and guide end portions of the surface modifying article away from a plane of the working surface.

2. The adapter of claim 1, wherein the retaining assembly for each corresponding one of the surfaces modifying articles includes a recess in a major surface of the carrier for receiving a corresponding one of the leading edge portions.

3. The adapter of claim 1, wherein each of the plurality of surface modifying articles includes a generally planar member.

4. The adapter of claim 3, wherein each of the generally planar members has generally straight edges.

5. The adapter of claim 4, wherein each of the plurality of surface modifying articles has first and second opposing surfaces, wherein the first opposing surface carries abrasive particles thereon, and the second opposing surface includes a retaining assembly that comprises a releasable attachment mechanism.

6. The adapter of claim 5, wherein the releasable attachment mechanism of the second opposing surface includes one of a hook and loop attachment mechanism member.

7. The adapter of claim 5, wherein the releasable attachment mechanism of the second opposing surface includes a pressure sensitive adhesive.

8. The adapter of claim 5, wherein the attachment mechanism of the second opposing surface includes a releasable mechanical attachment mechanism and the carrier includes a corresponding attachment mechanism for cooperating with the releasable mechanical attachment mechanism, whereby the surface modifying article is manually attachable and detachable therefrom.

9. The adapter of claim 1, wherein the rotatable carrier including a supporting plate defining a support major surface and formed from a material selected from the group consisting of fiberglass, rubber, wood, and metal.

10. The adapter of claim 9, wherein the retaining assembly is connected to the carrier and includes a supporting member to which at least one of the surface modifying articles is attached so that the leading edge thereof is retained from engagement with the working surface to be worked on.

11. A surface modifying system for surface modifying a working surface, the system comprising:

a surface modifying power tool having a driving member rotatable about an axis; and a surface modifying tool adapter connectable to the driving member, the surface modifying tool adapter including:

a rotatable carrier;

a plurality of surface modifying articles on the carrier, each of the surface modifying articles having a major surface modifying surface and at least a leading edge portion; and a retaining assembly on one of the carrier and the surface modifying article for retaining the leading edge portion of each of the surface modifying articles in spaced apart relationship from a working surface to be worked on during surface modification by the major surface, the retaining assembly including a discontinuous layer of adhesive on a second major surface of the surface modifying article opposite the major surface modifying surface.

12. A surface modifying assembly joinable to a surface modifying tool assembly, the surface modifying assembly comprising:

a generally elongated body having first and second opposed major surfaces, and at least a leading edge portion;

a surface modifying material on at least a portion of one of the first and second major surfaces that is spaced from the leading edge for modifying a working surface in a working plane;

a first attachment mechanism portion for releasably attaching the leading edge portion to the surface modifying tool assembly;

a second attachment mechanism portion spaced from the first attachment portion for releasably holding a segment of the body against the surface modifying tool assembly so that the surface modifying material is generally linearly spaced from the leading edge portion and from a working plane; and a resilient pad disposed between the body and the second attachment mechanism.

13. The surface modifying assembly of claim 12, wherein the leading edge is insertable into an opening formed in a major surface of a carrier of the tool assembly.

14. The surface modifying assembly of claim 12, wherein the surface modifying material includes an abrasive material.

15. The surface modifying assembly of claim 12, wherein the resilient pad is releasably attached to the body.

16. The surface modifying assembly of claim 12, wherein the first and second attachment mechanisms are releasable attachment mechanisms so the surface modifying assembly may be used as a replaceable insert.

17. The surface modifying assembly of claim 12, wherein the resilient pad is a foam pad.

18. The surface modifying assembly of claim 12, wherein the surface modifying material has straight edges.

* * * * *